US010683784B2

(12) United States Patent
Tada et al.

(10) Patent No.: US 10,683,784 B2
(45) Date of Patent: Jun. 16, 2020

(54) OIL MIST SEPARATOR

(71) Applicant: Honda Motor Co., Ltd., Tokyo (JP)

(72) Inventors: Kazushi Tada, Saitama (JP); Yuki Tomitani, Saitama (JP); Yohei Kanai, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/195,875

(22) Filed: Nov. 20, 2018

(65) Prior Publication Data

US 2020/0157987 A1 May 21, 2020

(51) Int. Cl.
*F01M 13/04* (2006.01)

(52) U.S. Cl.
CPC ..... *F01M 13/04* (2013.01)

(58) Field of Classification Search
CPC ..... F01M 13/04; F01M 2013/0433; F01M 2013/0438; F01M 13/0416; F01M 2013/0494
See application file for complete search history.

(56) References Cited

U.S. PATENT DOCUMENTS

| | | | | |
|---|---|---|---|---|
| 6,202,613 | B1 * | 3/2001 | Nagai | F01M 9/06 123/90.34 |
| 8,252,079 | B2 | 8/2012 | Gruhler et al. | |
| 2017/0204755 | A1 * | 7/2017 | Erdmann | B01D 45/16 |
| 2018/0119587 | A1 * | 5/2018 | Morishita | F01M 13/04 |

FOREIGN PATENT DOCUMENTS

| | | |
|---|---|---|
| JP | 2009013941 | 1/2009 |
| JP | 2016114034 | 6/2016 |
| JP | 2016114035 | 6/2016 |
| WO | 2013054578 | 4/2013 |

* cited by examiner

*Primary Examiner* — Long T Tran
(74) *Attorney, Agent, or Firm* — JCIPRNET

(57) ABSTRACT

The oil mist separator includes a separator case, a gas inlet portion, a gas outlet portion, a separating component and a wall portion. The separator case is formed with a gas flow path. The gas inlet portion introduces the blow-by gas into the separator case on one side of the gas flow path. The gas outlet portion discharges the blow-by gas out of the separator case on the other side of the gas flow path. The separating component is disposed in the separator case and located between the gas inlet and outlet portions to separate the oil mist from the blow-by gas when the blow-by gas flows along the gas flow path. The wall portion is erected on the bottom wall in the separator case and faces the gas outlet portion at a position leaning toward the gas outlet portion between the separating component and the gas outlet portion.

8 Claims, 5 Drawing Sheets

OIL MIST SEPARATOR

BACKGROUND

Technical Field

The disclosure relates to an oil mist separator for separating an oil mist from a blow-by gas in an internal combustion engine.

Description of Related Art

In an internal combustion engine for an automobile, it is known that a blow-by gas containing an unburned component leaking from a combustion chamber of an internal combustion engine into a crankcase is introduced into an intake system of an internal combustion engine to be combusted. Further, since the blow-by gas passing through the crankcase contains oil mist, in order to prevent the oil mist from flowing into the intake system of the internal combustion engine, it is possible to provide an oil mist separator for separation/removal of oil mist in blow-by gas inside a cylinder cover. For example, Patent Document 1 discloses a separating component composed of a perforated plate, a fiber material such as fleece, and an impact plate, thereby separating/removing the oil mist by colliding the blow-by gas with the impact plate after passing through the perforated plate and the fiber material.

[Patent Document 1] Japanese Laid-open No. 2016-114035

In the related art, even if the oil mist can be separated from the blow-by gas through the separating component, the oil mist on the downstream side of the separating component may be drawn in the blow-by gas again, and supplied to the intake system of the internal combustion engine with the blow-by gas.

SUMMARY

The disclosure provides an oil mist separator for preventing the oil mist located downstream relative to the separating component from being drawn in the separated blow-by gas and supplied to intake system of the internal combustion engine.

An oil mist separator of an exemplary embodiment of the disclosure is configured for separating an oil mist from a blow-by gas in an internal combustion engine, wherein the oil mist separator includes a separator case, a gas inlet portion, a gas outlet portion, a separating component, and a wall portion. The separator case is formed with a gas flow path through which the blow-by gas flows. The gas inlet portion introduces the blow-by gas into the separator case on one side of the gas flow path. The gas outlet portion discharges the blow-by gas out of the separator case on the other side of the gas flow path. The separating component is disposed in the separator case and located between the gas inlet portion and the gas outlet portion to separate the oil mist from the blow-by gas when the blow-by gas flows along the gas flow path. The wall portion is erected on a bottom wall in the separator case, and faces the gas outlet portion at a position leaning toward the gas outlet portion between the separating component and the gas outlet portion.

DESCRIPTION OF THE EMBODIMENTS

Figure 1:
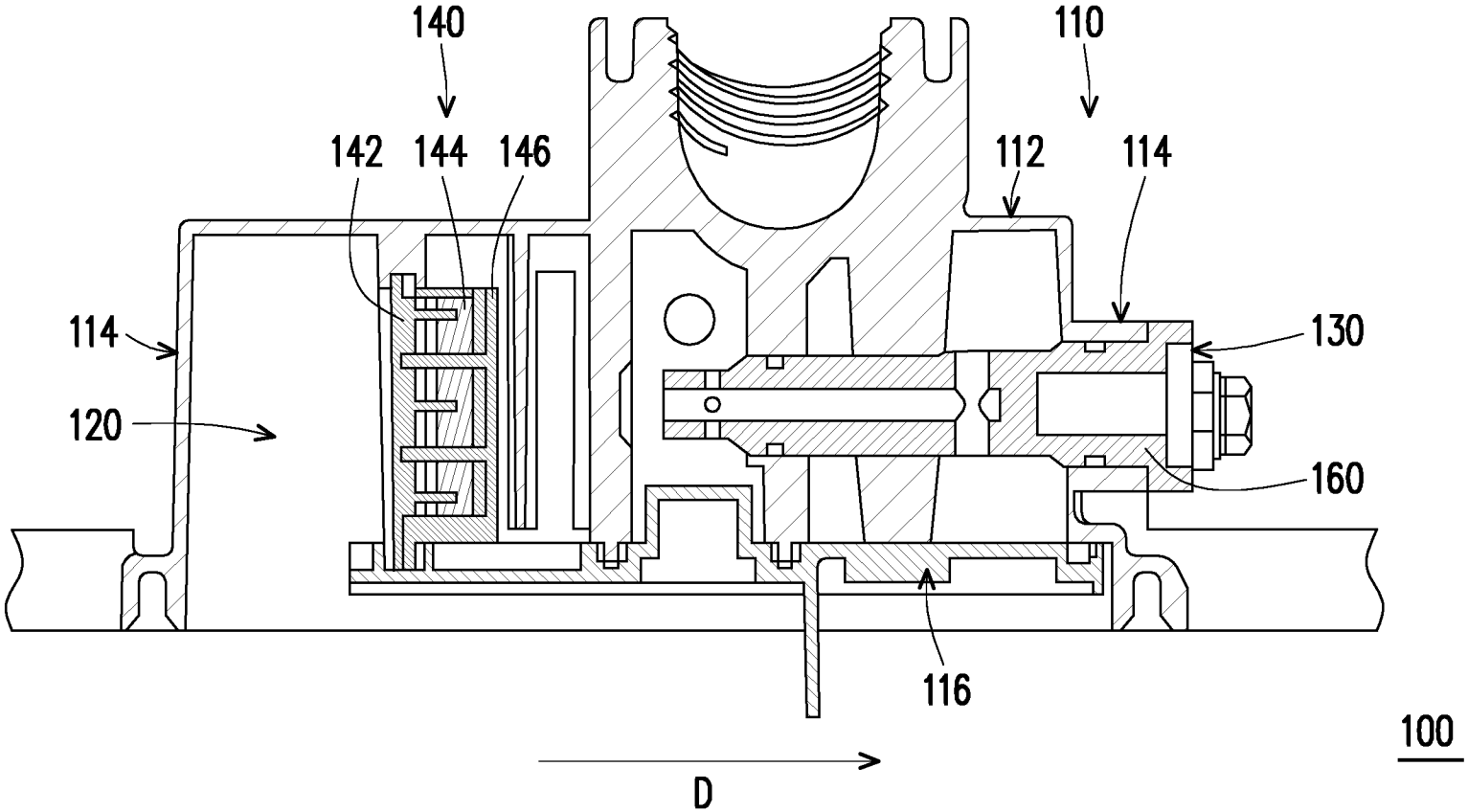
FIG. 1 is a schematic cross-sectional view illustrating an oil mist separator according to an exemplary embodiment of the disclosure.

Reference will now be made in detail to the present embodiments of the disclosure, examples of which are illustrated in the accompanying drawings. Wherever possible, the same reference numbers are used in the drawings and the description to refer to the same or like parts.

Figure 2:
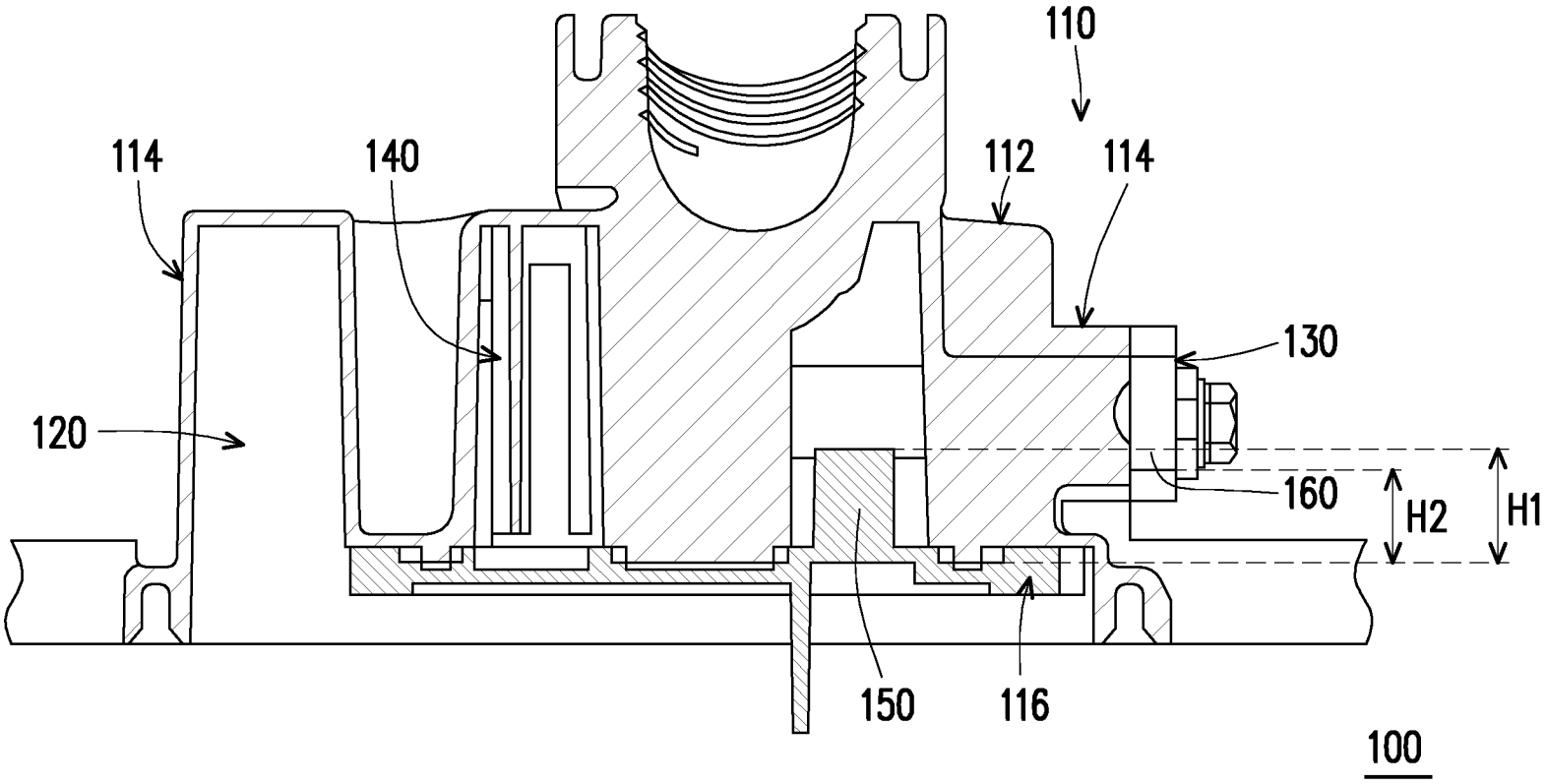
FIG. 2 is another schematic cross-sectional view of the oil mist separator in FIG. 1.

FIG. 1 is a schematic cross-sectional view illustrating an oil mist separator according to an exemplary embodiment of the disclosure, and FIG. 2 is another schematic cross-sectional view of the oil mist separator in FIG. 1. Referring to FIG. 1 and FIG. 2, in the present embodiment, an oil mist separator 100 includes a separator case 110, a gas inlet portion 120, a gas outlet portion 130, a separating component 140, and a wall portion 150. The separator case 110 includes a top wall 112, a plurality of side walls 114, and a bottom wall 116. The top wall 112 and the plurality of side walls 114 are connected to each other to constitute a cover structure having an accommodation space, and the bottom wall 116 is assembled to the cover structure in a manner of facing the top wall 112, thereby constituting the separator case 110, and the accommodating space in the separator case 110 can be formed with a gas flow path through which a blow-by gas flows (details as described below). However, the disclosure provides no limitation to the construction of the separator case 110, which may be adjusted as needed.

Further, the gas inlet portion 120 is an opening structure provided in one of the side walls 114 of the separator case 110, and introduces the blow-by gas into the separator case 110 on one side of the gas flow path (for example, the flow direction indicated by the arrow D shown in FIG. 1). On the other hand, the gas outlet portion 130 is an opening structure provided in another side wall 114 of the separator case 110, and discharges the blow-by gas out of the separator case 110 on the other side of the gas flow path (for example, the flow direction indicated by the arrow D shown in FIG. 1). The separating component 140 includes a perforated plate 142, a fiber material 144 such as fleece, an impact plate 146 and so on, but is not limited thereto. The separating component 140 is disposed within the separator case 110 and located between the gas inlet portion 120 and the gas outlet portion 130. In this manner, the blow-by gas flows along the gas flow path (for example, the flow direction indicated by the arrow D shown in FIG. 1) formed between the gas inlet portion 120 and the gas outlet portion 130, and flows through the separating component 140 located between the gas inlet portion 120 and the gas outlet portion 130 when the blow-by gas flows along the gas flow path. On this occasion, the blow-by gas is accelerated after being throttled by the perforated plate 142 to collide with the impact plate 146, thereby separating the oil mist from the blow-by gas. Thereafter, the blow-by gas from which the oil mist is separated flows to the gas outlet portion 130, and the separated oil mist is aggregated into oil droplets having larger volume by the fiber material 144 and discharged out of the separator case 110 (the method of discharging the oil droplets is described below).

In the exemplary embodiment, the oil mist separator 100 further includes a check valve 160. The check valve 160 is disposed at the gas outlet portion 130 for opening or closing the gas outlet portion 130 to control whether the blow-by gas in the separator case 110 flows out of the gas outlet portion 130 or not. That is, when the check valve 160 is opened, the blow-by gas from which the oil mist is separated may flow from the gas outlet portion 130, and when the check valve 160 is closed, the blow-by gas from which the oil mist is separated does not flow from the gas outlet portion 130. Please refer to the following description regarding when the check valve 160 controls whether or not the blow-by gas flows from the gas outlet portion 130. However, in other embodiments that are not shown, the oil mist separator 100 may also be provided with other kinds of valves at the gas outlet portion 130. The disclosure provides no limitation to the type and setting of the valve, which may be adjusted according to needs.

Figure 3:
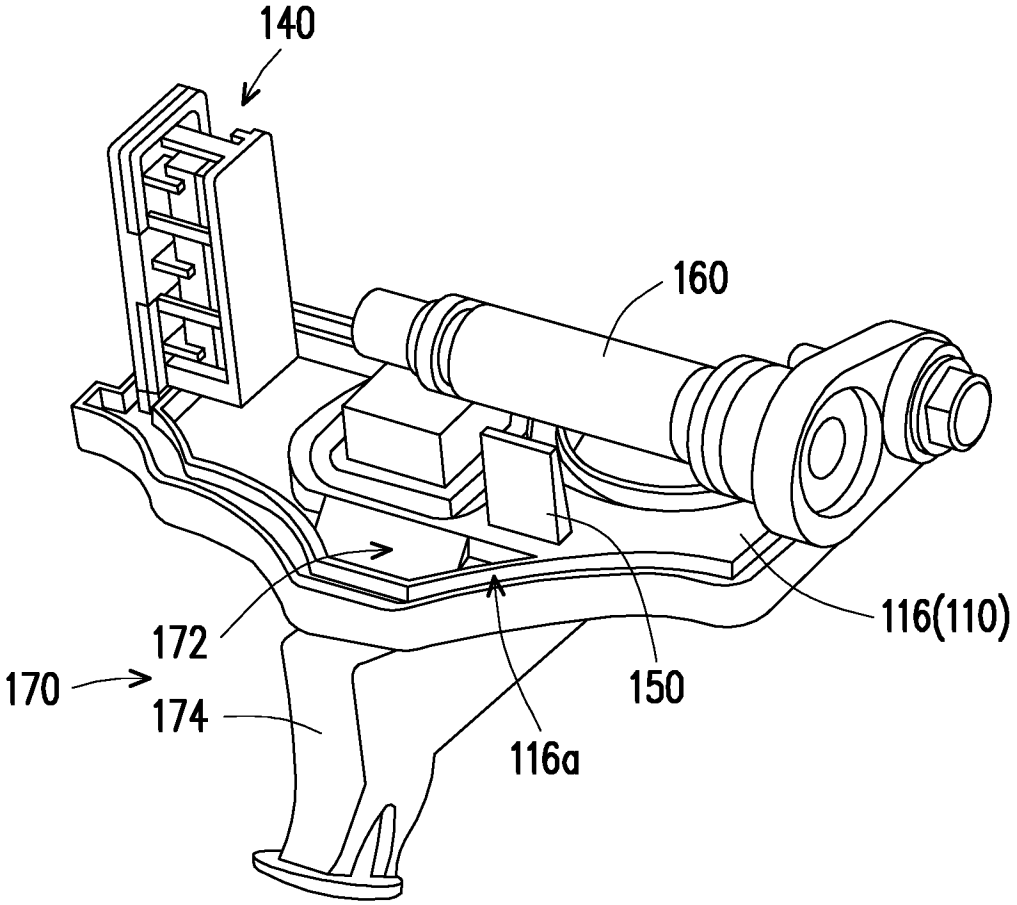
FIG. 3 is a perspective view of a separating component, a bottom wall and a check valve of the oil mist separator in FIG. 1.
Figure 4:
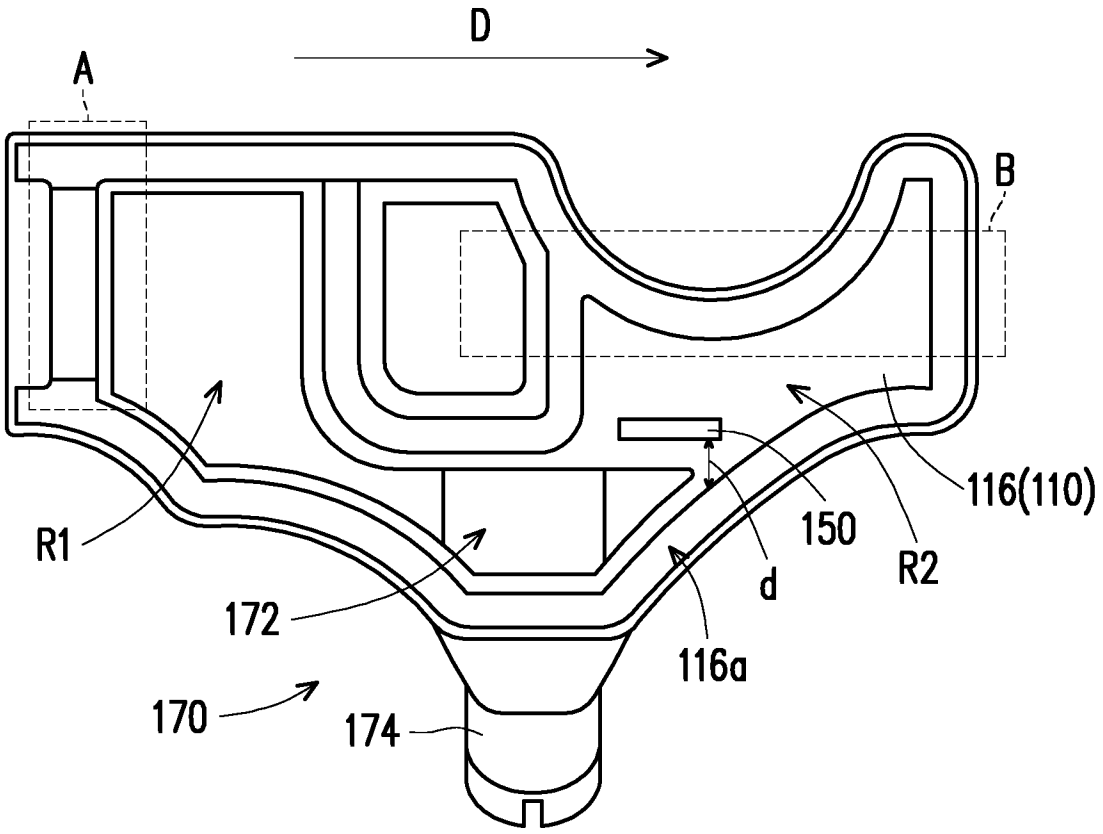
FIG. 4 is a top view of the bottom wall in FIG. 3.

FIG. 3 is a perspective view of a separating component, a bottom wall and a check valve of the oil mist separator in FIG. 1. FIG. 4 is a top view of the bottom wall in FIG. 3. Referring to FIG. 2 to FIG. 4, in the exemplary embodiment, the wall portion 150 is erected on the bottom wall 116 in the separator case 110, and faces the gas outlet portion 130 at a position leaning forward the gas outlet portion 130 between the separating component 140 and the gas outlet portion 130. More specifically, the wall portion 150 is a plate structure that faces the gas outlet portion 130. The wall portion 150 protrudes from the bottom wall 116 in a direction toward the top wall 112 from the bottom wall 116 and faces the lateral surface of the check valve 160 disposed at the gas outlet portion 130, thereby facing the gas outlet portion 130 at a position leaning forward the gas outlet portion 130 between the separating component 140 and the gas outlet portion 130. Also, preferably, the height H1 of the wall portion 150 relative to the bottom wall 116 is equal to or higher than the height H2 of the lowermost side of the gas outlet portion 130 (i.e., the lowermost side of the check valve 160) relative to the bottom wall 116 (e.g., as shown in FIG. 2, the height H1 of the wall portion 150 is slightly higher than the height H2 of the lowermost side of the gas outlet portion 130/the check valve 160). In this manner, the wall portion 150 may prevent the oil mist which is located downstream relative to the separating component 140 (that is, between the separating component 140 and the gas outlet portion 130) from being drawn in the separated blow-by gas and flow out of the gas outlet portion 130 along with the blow-by gas, while also guiding the blow-by gas to flow smoothly toward the gas outlet portion 130. The "downstream" refers to being relatively on the rear side of the flow path of the blow-by gas, and likewise, the "upstream" refers to being relatively on the front side of the flow path of the blow-by gas, the same meaning applies to the following description. However, the disclosure is not limited thereto and may be adjusted as needed.

Please refer to FIG. 3 and FIG. 4 for the relative positions of the separating component 140, the bottom wall 116, and the gas outlet portion 130/check valve 160. In the exemplary embodiment, the separating component 140 is disposed at a position of the bottom wall 116 corresponding to the region A, the check valve 160 is disposed at a position of the bottom wall 116 corresponding to the region B, and the region B corresponds to the gas outlet portion 130. It can be obtained that after the oil mist is separated from the blow-by gas by the separating component 140 corresponding to the region A, the blow-by gas flows from the separating component 140 along the flow direction indicated by the arrow D to the gas outlet portion 130 corresponding to the region B, and is controlled to flow out or not to flow out of the gas outlet portion 130 by opening or closing the gas outlet portion 130 through the check valve 160. The oil mist separated by the separating component 140 is aggregated into oil droplets and dripped to the bottom wall 116, and may also be floated around the bottom wall 116. On this occasion, since the wall portion 150 is erected on the bottom wall 116, it is possible not only to prevent the oil mist located downstream relative to the separating component 140 from being drawn into the separated blow-by gas, even if the oil mist located downstream relative to the separating component 140 is drawn into the separated blow-by gas, the blow-by gas collides with the wall portion 150 facing the gas outlet portion 130 before flowing out of the gas outlet portion 130, it is also possible to separate the oil mist that is drawn into the blow-by gas from the blow-by gas again, thereby preventing the oil mist from flowing out of the gas outlet portion 130 along with the blow-by gas.

Further, in the exemplary embodiment, the bottom wall 116 is provided with an oil discharge portion 170 located downstream relative to the separating component 140 on a gas flow path (for example, a flow direction indicated by an arrow D shown in FIG. 1) to discharge the oil droplets aggregated by the oil mist separated by the separating component 140 out of the separator case 110. Specifically, the oil discharge portion 170 includes a discharge port 172 and a discharge pipe 174; the discharge port 172 is located on the bottom wall 116, and the discharge pipe 174 extends from the bottom wall 116 to the outside of the separator case 110 to serve as a pipe structure communicating the inside and outside of the separator case 110, but the disclosure provides no limitation to the implementation of the oil discharge portion 170, which may be adjusted as needed. In this manner, the oil mist separated by the separating component 140 is aggregated into oil droplets and dripped to the bottom wall 116, and flows out of the separator case 110 through the oil discharge portion 170 which is located downstream relative to the separating component 140. On this occasion, since the wall portion 150 is located downstream relative to the oil discharge portion 170 on the gas flow path, and the wall portion 150 is located between the oil discharge portion 170 and the gas outlet portion 130, so that the wall portion 150 can prevent the oil mist located downstream relative to the separating component 140 and the oil discharge portion 170 from being drawn into the separated blow-by gas and flowing out of the gas outlet portion 130 along with the blow-by gas.

In addition, in the exemplary embodiment, the wall portion 150 is erected on the bottom wall 116 in the separator case 110 in a manner that a gap d is provided between the wall portion 116 and the side wall (at an edge 116*a* corresponding to the bottom wall 116 after assembling) of the separator case 110, thereby preventing the separated oil mist from being accumulated in a region located downstream relative to the wall portion 150 on the bottom wall 116, but the disclosure is not limited thereto. Further, in the bottom wall 116, a portion R1 located downstream relative to the separating component 140 and located upstream relative to the oil discharge portion 170 on the gas flow path (for example, the flow direction indicated by the arrow D shown in FIG. 1) is inclined downward toward the oil discharge portion 170 from the separating component 140 (corresponding to the region A), and a portion R2 located downstream relative to the oil discharge portion 170 and located upstream relative to the gas outlet portion 130 on the gas flow path (for example, the flow direction indicated by the arrow D shown in FIG. 1) is inclined downward toward the oil discharge portion 170 from the gas outlet portion 130 (corresponding to the region B). That is, the portions R1 and R2 adjacent to the oil discharge portion 170 on the bottom wall 116 are both inclined downward toward the oil discharge portion 170, thereby facilitating the oil droplets dripping to the bottom wall 116 to flow to the oil discharge portion 170 at a lower level and be discharged out of the separator case 110. However, the disclosure is not limited thereto, which may be adjusted as needed.

Figure 5:
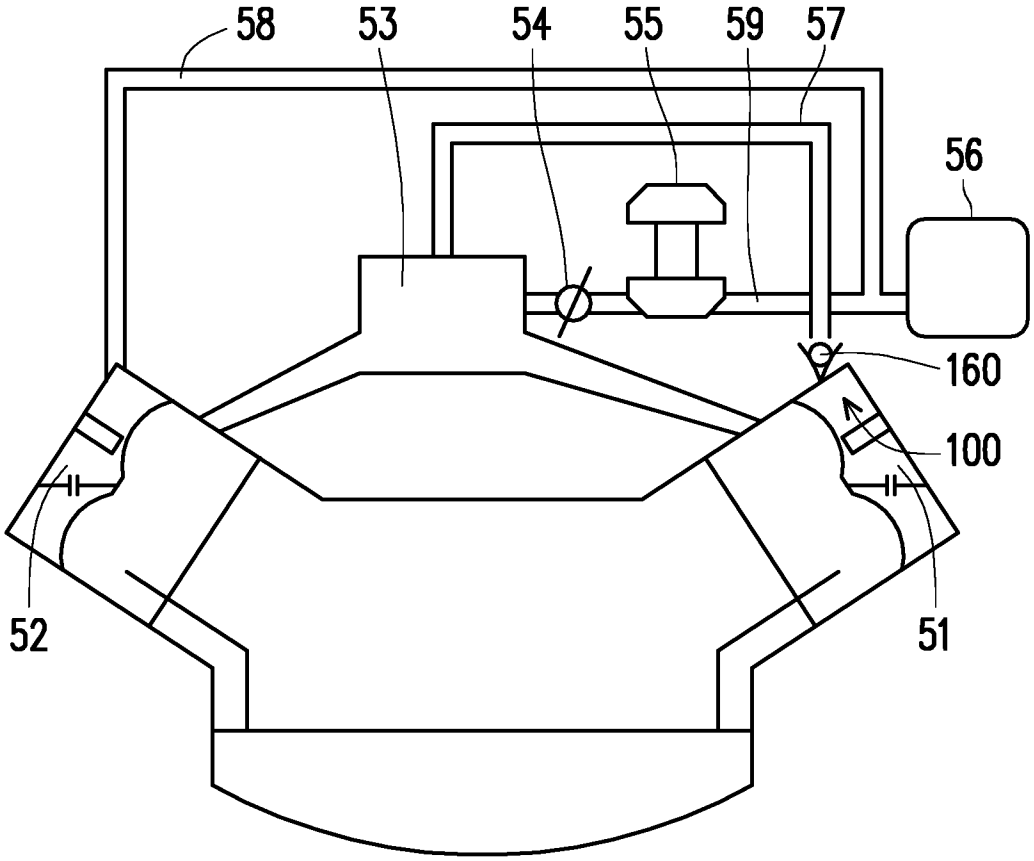
FIG. 5 is a schematic view illustrating the composition of an internal combustion engine used by the oil mist separator in FIG. 1.

FIG. 5 is a schematic view illustrating the composition of an internal combustion engine used by the oil mist separator in FIG. 1. Referring to FIG. 5, in the exemplary embodiment, the oil mist separator 100 may be applied to the internal combustion engine 50. Specifically, the internal combustion engine 50 includes a positive crankcase ventilation (PCV) chamber 51, a breather chamber 52, an intake manifold 53, a throttle valve 54, a turbine 55, an air cleaner 56, and the like, and a plurality of passages 57, 58, 59 connecting the above components. The passage 58 connects the breather chamber 52 with the intake manifold 53, and the passage 59 connects the throttle valve 54 to the air cleaner 56. The passage 57 directly connects the PCV chamber 51 to the intake manifold 53 without passing through the passage 59, but the disclosure is not limited thereto.

In the case where the oil mist separator 100 is mounted to the internal combustion engine 50, the oil mist separator 100 may be mounted to the PCV chamber 51, and the passage 57 directly connects the gas outlet portion 130/check valve 160 of the oil mist separator 100 mounted to the PCV chamber 51 and the intake manifold 53 without passing through the passage 59. The downstream end of the oil mist separator 100 (i.e., corresponding to the gas outlet portion 130/check valve 160) communicates with the intake system located downstream relative to the throttle valve 54 used in the internal combustion engine 50, thereby separating the oil mist from the blow-by gas flowing into the PCV chamber 51 through the oil mist separator 100, and the check valve 160 is used as a PCV valve to open or close the PCV chamber 51.

In this manner, when the intake manifold 53 is in the negative pressure state, the check valve 160 is opened so that the blow-by gas is sucked into the intake manifold 53 via the PCV chamber 51, the check valve 160 and the passage 57. In this process, the oil mist contained in the blow-by gas is separated/removed through the oil mist separator 100 (corresponding to the position of the check valve 160) in the PCV chamber 51, and then the blow-by gas not containing the oil mist is supplied from the check valve 160 to the intake manifold 53 via the passage 57. In the meantime, fresh air is supplied to the crankcase via the passage 58 and the internal space of the breather chamber 52 to ventilate the crankcase. In contrast, when the intake manifold 53 is in the positive pressure state, the check valve 160 is closed so that blow-by gas is sucked into the passage 59 that serves as the intake system located upstream relative to the throttle valve 54 at this time via the breather chamber 52 and the passage 58. During this process, the oil mist contained in the blow-by gas is separated/removed in the breather chamber 52 (for example, an oil mist separator 100 or other separating component (not shown) may also be installed in the breather chamber 52), and then the blow-by gas that does not contain the oil mist is supplied from the throttle valve 54 to the intake manifold 53. That is, the check valve 160 is opened when the intake manifold 53 is in a negative pressure state to allow the blow-by gas to flow from PCV chamber 51 to the passage 57, and the check valve 160 is closed when the intake manifold 53 is in the positive pressure state to control the flow of the blow-by gas from which the oil mist has been separated in the PCV chamber 51. However, the above-mentioned application of the oil mist separator 100 in the internal combustion engine (particularly the PCV chamber 51) is only one of the examples, and the disclosure provides no limitation to the application of the oil mist separator 100, which may be adjusted according to needs.

In summary, in the oil mist separator of the embodiment of the disclosure, a separating component for separating the oil mist from the blow-by gas is installed in the separator case, and the wall portion is erected on the bottom wall in the separator case and faces the gas outlet portion at a position leaning toward the gas outlet portion between the separating component and the gas outlet portion on the gas flow path. That is, during the process of flowing to the gas outlet portion, the blow-by gas separated by the separating component collides with the wall portion again to separate the oil mist, thereby reducing the possibility that the oil mist located downstream relative to the separating component is drawn into the separated blow-by gas again. Additionally, since the height of the wall portion is equal to or higher than the height of the lowermost side of the gas outlet portion, and the wall portion is erected on the bottom wall in the manner that a gap is provided between the wall portion and the sidewall of the separator case, so that the wall portion can guide the blow-by gas to flow smoothly toward the gas outlet portion, and prevent the separated oil mist from being accumulated on the region of the bottom wall downstream relative to the wall portion. Accordingly, the oil mist separator in the disclosure can prevent the oil mist located downstream relative to the separating component from being drawn into the separated blow-by gas and supplied to the intake system of the internal combustion engine along with the blow-by gas.

In an oil mist separator according to an exemplary embodiment of the disclosure, the gas outlet portion is disposed on a side wall of the separator case, and a height of the wall portion relative to the bottom wall is equal to or higher than a height of the lowermost side of the gas outlet portion relative to the bottom wall.

An oil mist separator according to an exemplary embodiment of the disclosure further includes a check valve disposed at the gas outlet portion, a height of the wall portion relative to the bottom wall is equal to or higher than a height of the lowermost side of the check valve relative to the bottom wall.

In an oil mist separator according to an exemplary embodiment of the disclosure, the wall portion is erected on the bottom wall in the separator case in a manner that a gap is provided between the wall portion and a side wall of the separator case.

In an oil mist separator according to an exemplary embodiment of the disclosure, the bottom wall has an oil discharge portion located downstream relative to the separating component on the gas flow path to discharge the oil droplets aggregated by the oil mist separated by the separating component out of the separator case.

In an oil mist separator according to an exemplary embodiment of the disclosure, the wall portion is located downstream relative to the oil discharge portion on the gas flow path.

In an oil mist separator according to an exemplary embodiment of the disclosure, the wall portion is located between the oil discharge portion and the gas outlet portion.

In an oil mist separator according to an exemplary embodiment of the disclosure, in the bottom wall, a portion located downstream relative to the separating component and located upstream relative to the oil discharge portion on the gas flow path is inclined downward from the separating component toward the oil discharge portion, and a portion located downstream relative to the oil discharge portion and located upstream relative to the gas outlet portion on the gas flow path is inclined downward from the gas outlet portion toward the oil discharge portion.

In an oil mist separator according to an exemplary embodiment of the disclosure, the wall portion is a plate structure facing the gas outlet portion.

In an oil mist separator according to an exemplary embodiment of the disclosure, in the case where the oil mist separator is installed in the internal combustion engine, a downstream end of the oil mist separator communicates with an intake system located downstream relative to a throttle valve used in the internal combustion engine.

Based on the above, in the oil mist separator of the embodiment of the disclosure, a separating component for separating the oil mist from the blow-by gas is installed in the separator case, and the wall portion is erected on the bottom wall in the separator case and faces the gas outlet portion at a position leaning toward the gas outlet portion between the separating component and the gas outlet portion on the gas flow path. That is, during the process of flowing to the gas outlet portion, the blow-by gas separated by the separating component collides with the wall portion again to separate the oil mist, thereby reducing the possibility that the oil mist located downstream relative to the separating component is drawn in the separated blow-by gas again. Accordingly, the oil mist separator in the embodiment of the disclosure can prevent the oil mist located downstream relative to the separating component from being drawn in the separated blow-by gas and supplied to the intake system of the internal combustion engine.

What is claimed is:

1. An oil mist separator for separating an oil mist from a blow-by gas in an internal combustion engine, wherein the oil mist separator comprises:

a separator case, formed with a gas flow path through which the blow-by gas flows;

a gas inlet portion, introducing the blow-by gas into the separator case on a side of the gas flow path;

a gas outlet portion, discharging the blow-by gas out of the separator case on the other side of the gas flow path;

a separating component, disposed in the separator case and located between the gas inlet portion and the gas outlet portion to separate the oil mist from the blow-by gas when the blow-by gas flows along the gas flow path;

a wall portion, erected on a bottom wall in the separator case, and facing the gas outlet portion at a position leaning toward the gas outlet portion between the separating component and the gas outlet portion, wherein the gas outlet portion is disposed on a side wall of the separator case, a height of the wall portion relative to the bottom wall is equal to or higher than a height of the lowermost side of the gas outlet portion relative to the bottom wall; and a check valve, disposed at the gas outlet portion, wherein the height of the wall portion relative to the bottom wall is equal to or higher than a height of the lowermost side of the check valve relative to the bottom wall.

2. The oil mist separator according to claim 1, wherein the wall portion is erected on the bottom wall in the separator case in a manner that a gap is provided between the wall portion and a side wall of the separator case.

3. The oil mist separator according to claim 1, wherein the bottom wall has an oil discharge portion located downstream relative to the separating component on the gas flow path to discharge oil droplets aggregated by the oil mist separated by the separating component out of the separator case.

4. The oil mist separator according to claim 3, wherein the wall portion is located downstream relative to the oil discharge portion on the gas flow path.

5. The oil mist separator according to claim 3, wherein the wall portion is located between the oil discharge portion and the gas outlet portion.

6. The oil mist separator according to claim 3, wherein in the bottom wall, a portion located downstream relative to the separating component and located upstream relative to the oil discharge portion on the gas flow path is inclined downward toward the oil discharge portion from the separating component, and a portion located downstream relative to the oil discharge portion and located upstream relative to the gas outlet portion on the gas flow path is inclined downward toward the oil discharge portion from the gas outlet portion.

7. The oil mist separator according to claim 1, wherein the wall portion is a plate structure facing the gas outlet portion.

8. The oil mist separator according to claim 1, wherein in the case where the oil mist separator is installed in the internal combustion engine, a downstream end of the oil mist separator communicates with an intake system located downstream relative to a throttle valve used in the internal combustion engine.

* * * * *